US009312631B2

(12) United States Patent
Schrader

(10) Patent No.: US 9,312,631 B2
(45) Date of Patent: Apr. 12, 2016

(54) ELECTRICAL CONNECTOR

(71) Applicant: Phoenix Contact GmbH & Co. KG, Blomberg (DE)

(72) Inventor: Andreas Schrader, Delbrück (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 14/365,099

(22) PCT Filed: Dec. 18, 2012

(86) PCT No.: PCT/EP2012/075926
§ 371 (c)(1),
(2) Date: Jun. 12, 2014

(87) PCT Pub. No.: WO2013/092570
PCT Pub. Date: Jun. 27, 2013

(65) Prior Publication Data

US 2014/0335714 A1 Nov. 13, 2014

(30) Foreign Application Priority Data

Dec. 22, 2011 (DE) ..... 10 2011 122 111

(51) Int. Cl.

| | |
|---|---|
| ***H01R 13/62*** | (2006.01) |
| ***H01R 12/77*** | (2011.01) |
| ***H01R 13/58*** | (2006.01) |
| ***H01R 12/71*** | (2011.01) |
| *H01R 12/78* | (2011.01) |

(52) U.S. Cl.
CPC ..... *H01R 13/62* (2013.01); *H01R 12/71* (2013.01); *H01R 12/77* (2013.01); *H01R 12/772* (2013.01); *H01R 13/5812* (2013.01); *H01R 12/78* (2013.01)

(58) Field of Classification Search
CPC ..... H01R 12/78; H01R 23/66; H01R 23/722; H01R 13/62; H01R 12/77
USPC ..... 439/77, 79, 329, 492, 499
See application file for complete search history.

(56) References Cited

U.S. PATENT DOCUMENTS

| | | | |
|---|---|---|---|
| 4,715,824 | A | 12/1987 | Verhoeven |
| 4,749,361 | A | 6/1988 | Verhoeven |
| 5,516,984 | A | 5/1996 | Soes et al. |
| 5,860,832 | A | 1/1999 | Wayt et al. |
| 2008/0137332 | A1 | 6/2008 | Lo et al. |
| 2011/0045704 | A1 | 2/2011 | Li et al. |

FOREIGN PATENT DOCUMENTS

| | | |
|---|---|---|
| DE | 10045714 A1 | 5/2001 |
| DE | 100 65 972 | 7/2002 |

(Continued)

OTHER PUBLICATIONS

International Search Report for international application No. PCT/EP2012/075926.

*Primary Examiner* — Khiem Nguyen
(74) *Attorney, Agent, or Firm* — Mannava & Kang, P.C.; Arash Behravesh

(57) ABSTRACT

The invention relates to an electrical connector for electrical cable sections with a connecting sleeve (103) for receiving a first cable section and a fastening element (101) with a first fastening mandrel (105) for the form-fitting fastening of a first cable section in the connecting sleeve (103), wherein the fastening element (101) can be placed on the connecting sleeve (103) in order to fasten the first cable section in the connecting sleeve with a form fit by means of the first fastening mandrel (105).

14 Claims, 6 Drawing Sheets

(56) References Cited

FOREIGN PATENT DOCUMENTS

| | | | |
|---|---|---|---|
| DE | 19857624 | A1 | 2/2009 |
| DE | 10 2007 063 217 | | 7/2009 |
| EP | 0227153 | A1 | 7/1987 |
| EP | 0592101 | A1 | 4/1994 |
| EP | 0 773 608 | | 5/1997 |
| JP | 2001068184 | A | 3/2001 |
| JP | 2002203632 | A | 7/2002 |
| JP | 2002324607 | A | 11/2002 |
| JP | 2004071314 | A | 3/2004 |
| WO | 9833246 | A1 | 7/1998 |
| WO | 2012014884 | A1 | 2/2012 |

ELECTRICAL CONNECTOR

PRIORITY

The present application claims priority under 35 U.S.C. §371 to PCT Application PCT/EP2012/075926, filed on Dec. 18, 2012, which claims priority to German Patent Application No. 10 2011 122 111.9, filed on Dec. 22, 2011, the disclosures of which are hereby incorporated by reference in their entireties.

The present invention relates to an electrical connector for electrical conducting elements, in particular for flexible electrical conducting elements.

Known connectors for flexible electrical conducting elements, for example for flexible PCBs or LED strips, are based on a clamping principle and are usually constructed in such a way that an operator pushes one end to be connected of an electrical conducting element into a clamp and presses this end against a resilient contact element by means of a rotatably mounted knob, as described in EP 0 773 608 B1. Furthermore, connectors for flexible PCBs are known in which, after they have been inserted in a connecting region, the flexible PCBs are fixed beneath a mounted cover by means of a pressure means, as described in DE 10 2007 063 217 A1.

However, clamp-based fastening means require high clamping forces so that an electrical conducting element cannot be pulled out inadvertently. Moreover, the fastening system needs to have a relatively rigid structure, which is expensive to produce.

Moreover, to fasten electrical conducting elements, plug and socket contacts can be used which are, for example, soldered onto a flexible PCB. However, there is hereby always a need for additional strain relief in order to prevent unintentional separation of the electrical contacts.

The object of the present invention is therefore to provide an electrical connector with improved fastening properties.

This object is achieved by the features of the independent claims. Advantageous developments are the subject matter of the dependent claims, the drawings and the description.

The invention is based on the recognition that the above object can be achieved by an electrical connector with a fastening spike. The fastening spike can penetrate, for example, into an electrical conducting element, for example, into a flexible PCB or its substrate and so secure the latter from slipping out of the connector. In order to do this, the fastening spike can be received in an opening in the electrical conducting element, for example a substrate. The opening can either be prefabricated or generated by means of the fastening spike, which can be pointed for this purpose. In this way, the conducting paths of the conducting elements are not damaged, with the result that they can be reused. Electrical connectors, for example spring contacts, can be used for electrically contacting the conducting paths.

According to one aspect, the invention relates to an electrical connector for electrical conducting elements, in particular for flexible electrical conducting elements, with a connecting sleeve for receiving a first conducting element, and a fastening element with a first fastening spike for form-fit fastening a first conducting element in the connecting sleeve. The fastening element can be placed on the connecting sleeve in order to fasten the first conducting element with a form-fit in the connecting sleeve by means of the first fastening spike.

Form-fit fastening is understood to mean any mechanical fastening that restricts an ability of the electrical conducting element to move relative to the fastening spike.

As a result, flexible PCBs or LED strips can be connected in a very compact fashion. Furthermore, there is no need for soldering to do this. Moreover, only small forces are required to contact electrical conducting paths of the electrical conducting element because the strain relief is assured by the fastening spike. Owing to the use of the fastening spike, the electrical conducting element can be efficiently protected from being pulled out of the electrical connector. LED strips or flexible PCBs, or in general flexible conducting elements, which are connected by means of the electrical connector can thus for example be secured and retained in the connector.

According to one design, the electrical connector can be designed to fasten or retain a single conducting element. The electrical connector can hereby comprise an electrical connection via which an electrical coupling to the electrical conducting element can be achieved.

According to another design, however, the electrical connector can be provided to fasten or retain multiple, for example two, electrical conducting elements. Electrical conducting paths of the respective electrical conducting element can hereby be connected electrically by means of the connecting sleeve, wherein the respective conducting element can be fastened or fixed by means of a fastening spike associated with the respective conducting element.

The following embodiments refer in principle to both designs.

According to one embodiment, the invention relates to the electrical connector, wherein the connecting sleeve has a hollow cross-section, in particular a rectangular hollow cross-section. Consequently, the first electrical conducting element can be pushed into the connecting sleeve and be contacted electrically, for example by means of spring contacts.

According to one embodiment, the invention relates to the electrical connector, wherein the fastening element can be connected to the connecting sleeve, in particular can be connected by means of a snap-fit connection.

According to one embodiment, the invention relates to the electrical connector, wherein the connecting sleeve has at least one snap-fit projection and wherein the fastening element has at least one snap-fit recess for receiving the snap-fit projection, or wherein the connecting sleeve has at least one snap-fit recess and wherein the fastening element has at least one snap-fit projection. The snap-fit projections can be designed as snap-fit hooks. According to one embodiment, only two snap-fit hooks are provided on the connecting sleeve or on the fastening element and these engage correspondingly in two snap-fit recesses of the fastening element or of the connecting sleeve. Multiple snap-fit hooks and snap-fit recesses, which are arranged for example at the corners, can, however, also be provided.

According to one embodiment, the invention relates to the electrical connector, wherein the connecting sleeve is provided to retain a second electrical conducting element, and wherein the fastening element comprises a second fastening spike for form-fit fastening the second conducting element in the connecting sleeve. Consequently, two conducting elements can be electrically connected by means of the electrical connector and fastened by means of the fastening spikes.

According to one embodiment, the invention relates to the electrical connector, wherein the connecting sleeve has a sleeve wall with at least one opening for receiving at least one fastening spike. Consequently, the respective fastening spike can be introduced into an internal connecting space of the connecting sleeve in order to fasten the respective conducting element.

According to one embodiment, the invention relates to the electrical connector, wherein the respective fastening spike is designed so as to deform the respective conducting element, in particular to create a depression or an opening in order to produce the form-fit fastening.

According to one embodiment, the invention relates to the electrical connector, wherein the respective fastening spike is designed so as to penetrate at least partially into an insulating layer of the respective conducting element or to perforate an insulating layer of the respective conducting element in order to produce the form-fit fastening. To do this, the respective fastening spike can, for example, perforate an insulating strip between two conducting paths.

According to one embodiment, the invention relates to the electrical connector, wherein the respective fastening spike can be driven through the respective electrical conducting element or wherein the respective fastening spike is designed to perforate the respective electrical conducting element in order to produce the respective form-fit fastening.

According to one embodiment, the invention relates to the electrical connector, wherein the respective conducting element is a PCB, in particular a flexible PCB, wherein the respective PCB has a substrate and wherein the respective fastening spike is designed to penetrate into the respective substrate of the respective PCB, in particular to perforate the respective substrate, in order to produce the form-fit fastening.

According to one embodiment, the invention relates to the electrical connector, wherein the respective electrical conducting element has an opening, and wherein the respective fastening spike can be introduced into the respective opening, in each case in order to produce a form-fit fastening.

According to one embodiment, the invention relates to the electrical connector, wherein the connecting sleeve is provided to electrically contact at least one electrical conducting path of the respective electrical conducting element.

According to one embodiment, the invention relates to the electrical connector, wherein the connecting sleeve comprises at least one connecting space for receiving the respective electrical conducting element. According to one embodiment, a separate connecting space can be provided for each conducting element.

According to one embodiment, the invention relates to the electrical connector, wherein the connecting space comprises at least one electrical contact for electrically contacting at least one electrical conducting path of the respective conducting element. The electrical contact or the electrical contacts can be spring contacts.

According to one embodiment, the invention relates to the electrical connector, wherein the fastening element and the connecting sleeve, when joined together, form a pocket-like housing, in particular a water-tight housing. The connecting sleeve and/or the fastening element can hereby be provided with an insulating layer in order to prevent water from penetrating inside the pocket-like housing. Moreover, the pocket-like housing can have an electrically insulating effect.

According to one embodiment, the invention relates to the electrical connector according to one of the preceding claims, wherein a connecting space of the connecting sleeve is provided with plastic, in particular gel-like plastic, in order to receive the electrical conducting element so that it at least partially encloses it.

According to one embodiment, the invention relates to the electrical connector, wherein the respective fastening spike is formed from plastic, in particular from an insulating plastic. The respective fastening spike is preferably not conductive, i.e. can have an electrical conductivity that is less than the electrical conductivity of metals.

According to another aspect, the invention relates to the use of the electrical connector according to the invention to electrically contact at least one strip-like conducting path of an LED tape or at least one PCB, in particular a flexible PCB.

According to another aspect, the invention relates to a flexible PCB with a substrate, wherein an opening for form-fit fastening the flexible PCB by means of a fastening spike of an electrical connector, in particular of the connector according to the invention, is formed in the substrate.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

Other embodiments are explained in more detail with reference to the attached drawings, in which.

It is to be understood that both the foregoing general description and the following detailed description are exemplary and explanatory only, and are intended to provide an explanation of various embodiments of the present teachings.

Figure 1:
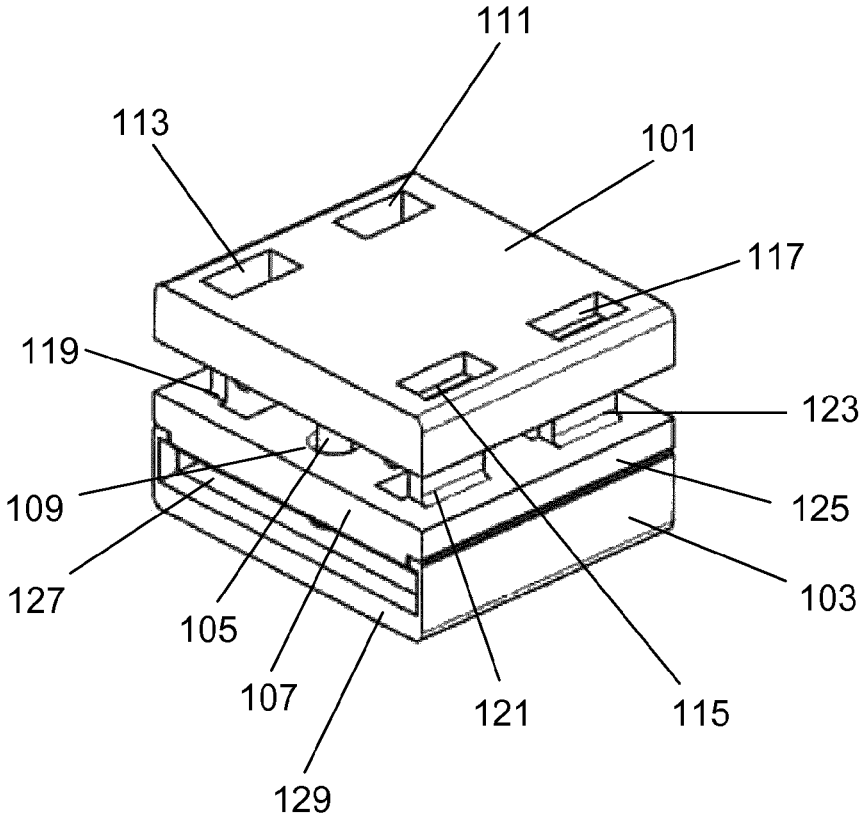
FIG. 1 shows an electrical connector.

FIG. 1 shows an electrical connector according to one embodiment. The electrical connector comprises a fastening element 101 and a connecting sleeve 103. The fastening element 101 comprises a first fastening spike 105 for fastening a first electrical conducting element (not shown in FIG. 1), for example a flexible PCB with an electrical conducting path or an LED strip.

The connecting sleeve 103 serves to receive the electrical conducting element and comprises a sleeve wall 107 which has at least one opening 109 for receiving the first fastening spike 105.

The fastening element 101 is, for example, formed in the form of a rectangular baseplate which has snap-fit recesses 111, 113, 115 and 117 at the corners. The snap-fit recesses 111 to 117 are provided so as to receive corresponding snap-fit projections 119, 121, 123 of the connecting sleeve 103 which are arranged at the corners of an upper sleeve wall 107 which forms a rectangular baseplate 125.

The connecting sleeve 103 has, for example, a hollow cross-section and a connecting space 127 for receiving the first electrical conducting element, wherein the connecting space 127 can have a rectangular cross-section. As a result, flat conducting elements such as, for example, LED strips or tapes can be introduced into the connecting space 127 such that they fit exactly. Electrical contacts for electrically contacting one or more conducting paths of the electrical conducting element can be provided in the connecting space 127.

The connecting space 127 of the connecting sleeve 103 can be provided for receiving electrical conducting elements on both sides. According to one embodiment, the connecting sleeve 103 can have, in addition to the connecting space 127, a further connecting space for receiving a second conducting element. Electrical contacts can be provided in the connecting spaces, said electrical contacts being connected together in pairs, in order to effect electrical fastenings between conducting paths, for example connections, of the conducting elements.

The connecting sleeve 103 can be formed in one or more pieces. Thus, for example, the baseplate 125 can be placed onto a U-shaped base part 129 of the connecting sleeve 103 or can be fastened to the latter. The baseplate 125 and the U-shaped base part 129 can, however, be formed integrally.

According to one embodiment, the connector illustrated in FIG. 1 can have multiple fastening spikes. According to another embodiment, however, the electrical connector can have a single fastening spike. As a result, contacting or connection with an LED strip or with a flexible PCB can, for example, be achieved. To do this, the connector illustrated in FIG. 1 can have a connection terminal which is electrically connected to the fastening spike.

Figure 2:
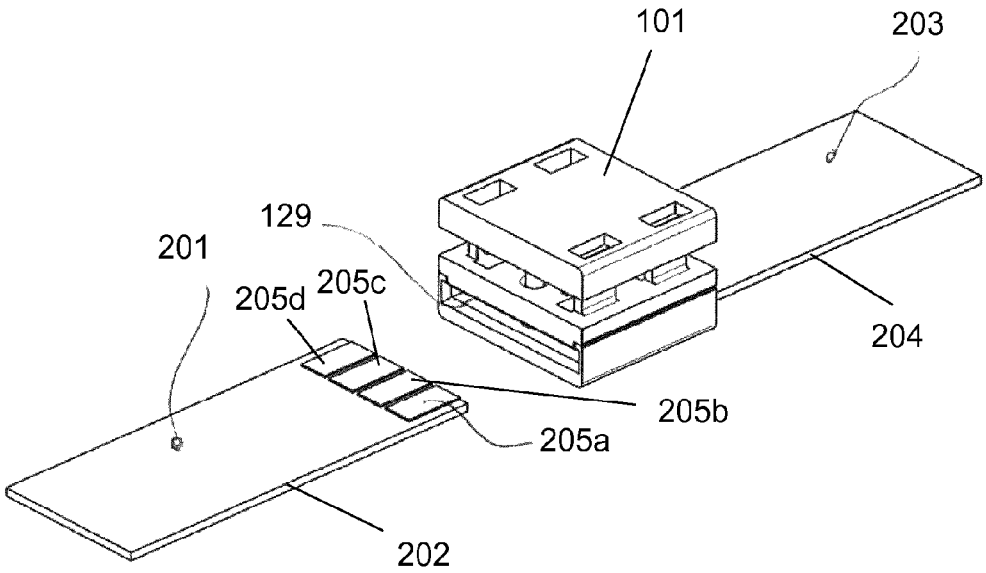
FIG. 2 shows the electrical connector from FIG. 1.

FIG. 2 shows the connector illustrated in FIG. 1 and two flexible PCBs 201, 203 which are each provided with conducting paths 205*a*, 205*b*, 205*c* and 205*d*. The conducting paths 205*a* to 205*d* are, for example, electrical connecting surfaces or connecting pads. The ends of the flexible PCBs 201 and 203 provided with the conducting paths 205*a* to 205*d* can be pushed by a user into corresponding connecting areas of the fastening element. The flexible PCBs 201, 203 are then fixed by pressing down the fastening element 101 which is thus snap-fitted to the connecting sleeve 103. Moreover, this fixing can be reinforced by the respective fastening spike perforating the respective PCB 201, 203.

The connecting sleeve 103 can have an electrical contact for each conducting path 205*a*, 205*b*, 205*c* and 205*d*. The electrical contacts, for example spring contacts, can be arranged in the connecting space 127 of the connecting sleeve or in opposite connecting spaces of the connecting sleeve 103 which can each be provided for an electrical conducting element.

According to one embodiment, the perforation can be replaced by a formation of a depression in the respective flexible PCB 201, 203 or in the respective substrate 202, 204 of the respective flexible PCB 201, 203 by the respective fastening spike. For this purpose, the fastening spikes can have, for example, rounded tips.

Figure 3:
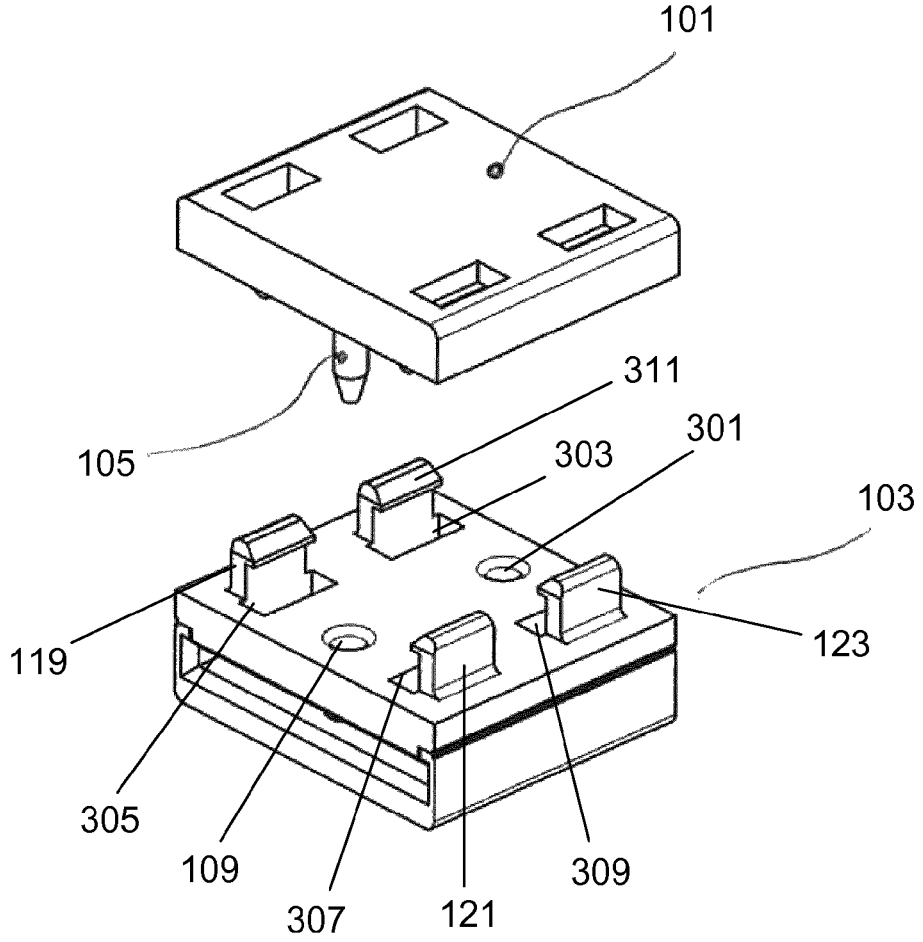
FIG. 3 shows elements of the electrical connector from FIG. 1.
Figure 4:
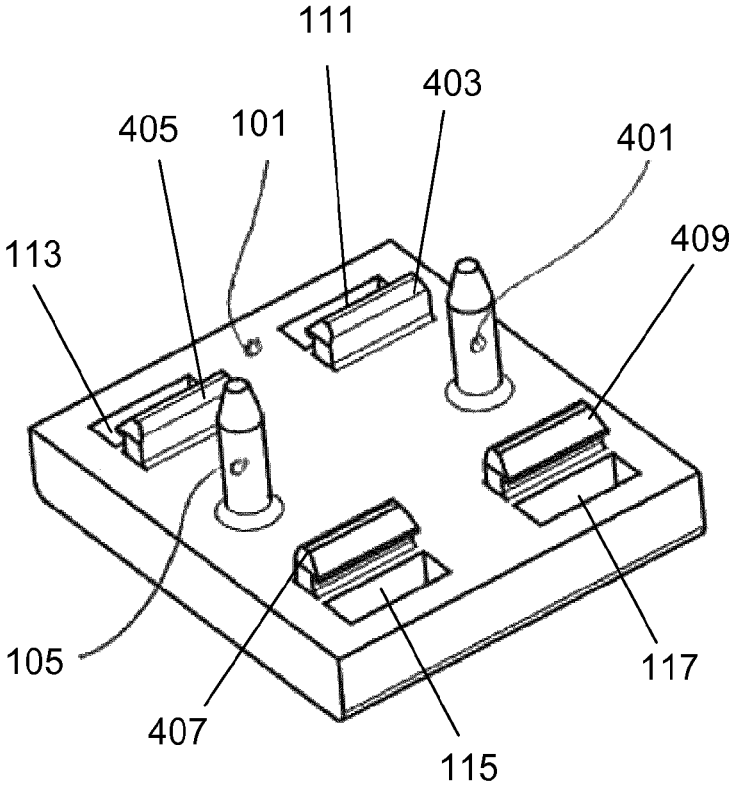
FIG. 4 shows a fastening element of the electrical connector from FIG. 1.

The elements of the electrical connector illustrated in FIGS. 1 and 2 are illustrated in detail in FIG. 3. The baseplate 125 comprises a second opening 301 for the second fastening spike 401 which is illustrated in FIG. 4. As illustrated in FIG. 4, the fastening element 101 can have further snap-fit projections 403, 405, 407 and 409 which are arranged at the corners of the fastening element 101 and are provided for a further snap-fit connection. For this purpose, the baseplate 125 can have further snap-fit recesses 303, 305, 307 and 309 which receive the snap-fit projections 403, 405, 407 and 409 so that they can be snap-fitted together. A further snap-fit projection 311 of the connecting sleeve 103, which can engage in the snap-fit recess 111 of the fastening element, is illustrated in FIG. 3.

An electrical connector with a connecting sleeve 501 and a fastening element 503 which can be placed onto the connecting sleeve 501 is in FIGS. 5*a* to 5*f*. The connecting sleeve 501 and/or the fastening element 503 can each be formed as a single piece.

The fastening element 503 comprises laterally arranged snap-fit projections 505, 507 which engage in corresponding snap-fit recesses 509, 511 of the connecting sleeve 501. The snap-fit recesses 509, 511 can be formed in the sides of the connecting sleeve 501. A snap-fit connection between the connecting sleeve 501 and the fastening element 503 is consequently formed.

Figure 5A:
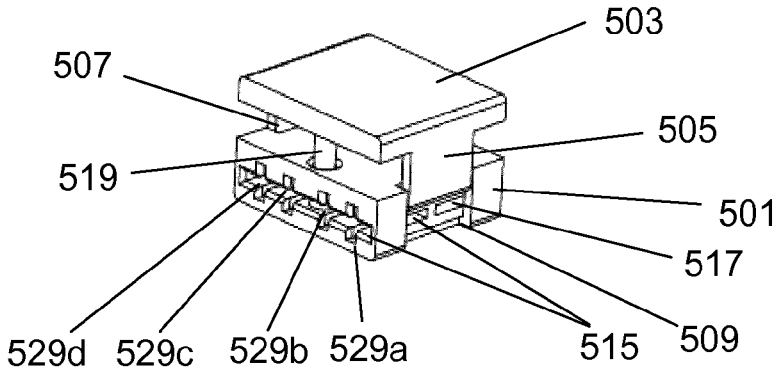
FIGS. 5*a* to 5*f* show an electrical connector.
Figure 5B:
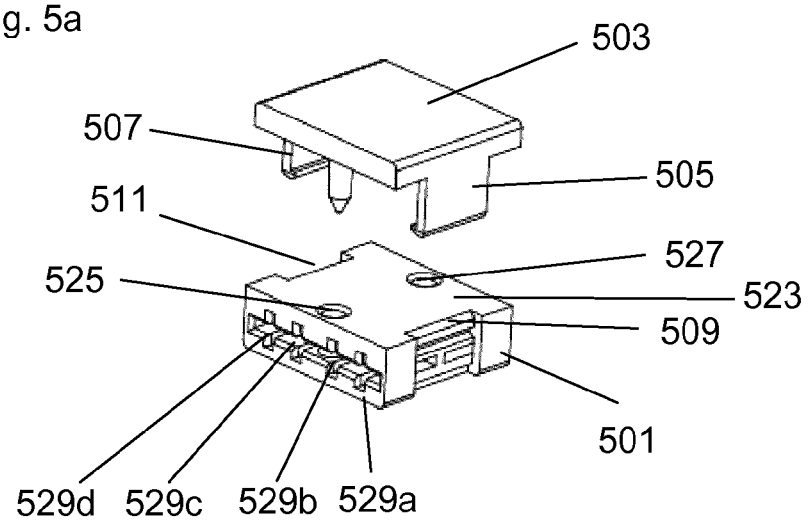
Figure 5C:
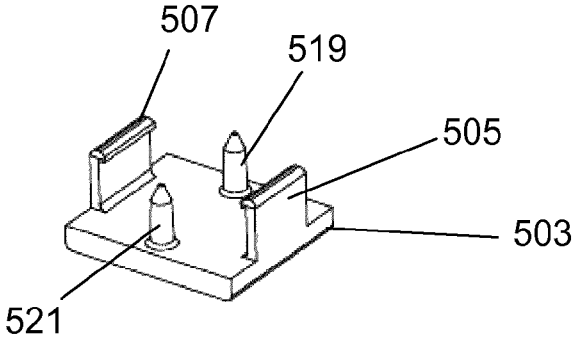
Figure 5D:
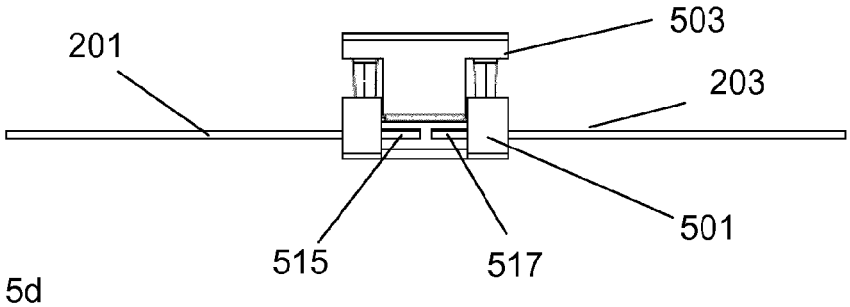
Figure 5E:
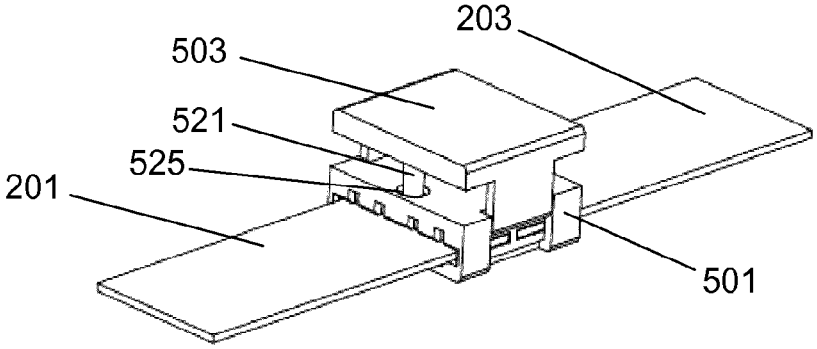
Figure 5F:
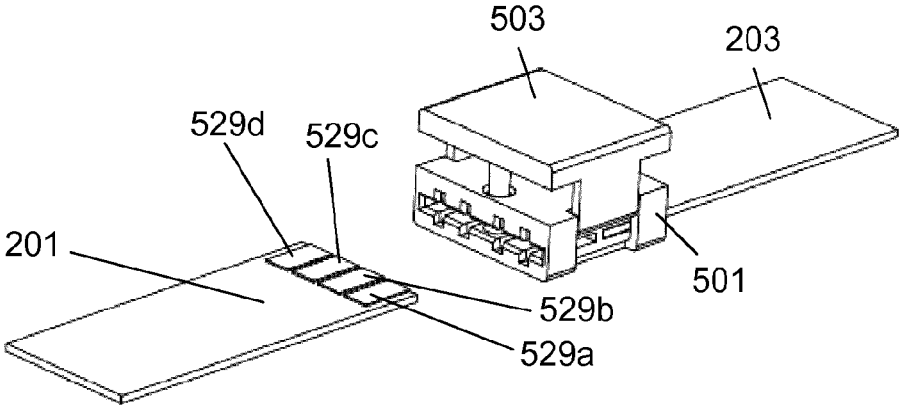

As illustrated in FIGS. 5*d*-5*f*, the electrical connector can be provided for electrically connecting the first conducting element 201 and the second conducting element 203. The conducting elements 201, 203 are each pushed from the side into a connecting space 515, 517 of the connecting sleeve 501 and each fastened with a form-fit there by means of a first fastening spike 519 which can be introduced into the connecting space 515, and by means of a second fastening spike 521 which can be introduced into the connecting space 517. To do this, the fastening spikes 519, 521 can perforate the respective PCB 201, 203 or their substrates, or engage in prefabricated openings in the PCBs 201, 203. The first fastening spike 519 and the second fastening spike 521 are formed on or fastened to the fastening element 503.

Openings 525, 527 are formed in a sleeve wall 523 of the connecting sleeve 501 in order to introduce the fastening spikes 519, 521 into the connecting spaces 515, 517.

Electrical contacts 529*a*, 529*b*, 529*c* and 529*d* are in each case arranged in the connecting spaces to electrically contact the conducting paths 205*a* to 205*d* of the PCBs 201, 203. The electrical contacts 529*a*, 529*b*, 529*c* and 529*d* can, for example, be formed as spring contacts. For this purpose, the electrical contacts 529*a*, 529*b*, 529*c* and 529*d* can each have contact elements, for example contact clips, arranged in pairs opposite each other.

The electrical contacts 529*a*, 529*b*, 529*c* and 529*d* can moreover each be electrically connected to each other in pairs. The fastening scheme can, for example, comprise electrical fastenings of the respective corresponding electrical contacts 529*a*-529*a*, 529*b*-529*b*, 529*c*-529 and 529*d*-529*d* of the PCBs 201, 203.

The connector illustrated in FIGS. 1 to 5 is designed to absorb tensile forces which can occur, for example, when LED strips or flexible PCBs are being installed or disassembled. For this purpose, the contacts of the flexible PCBs or the LED strips can be connected by means of resilient elements which can form electrical contacts.

The strain relief is achieved in particular by means of at least one fastening spike per conducting element, for example per LED strip. When the LED strips or the flexible PCBs are connected, the fastening spike is pressed through the flexible PCB by the user. The respective fastening spike is here arranged on the fastening element, the fastening element 101 snap-fitting to the connecting sleeve when, for example, the respective fastening spike or the fastening spikes is/are pressed through electrical conducting elements, so that a secure fastening and absorption of tensile forces are achieved. The respective fastening spike or spikes can here be arranged in such a way that no conducting paths are interrupted when the fastening spikes are pressed through the LED strips.

LIST OF REFERENCE NUMERALS

101 fastening element
103 connecting sleeve
105 fastening spike
107 sleeve wall
109 opening
111 snap-fit recess
113 snap-fit recess
115 snap-fit recess
117 snap-fit recess
119 snap-fit projection
121 snap-fit projection
123 snap-fit projection
125 baseplate
127 connecting space
129 U-shaped base part
201 flexible PCB
202 substrate
203 flexible PCB
204 substrate
205*a* conducting path

205*b* conducting path
205*c* conducting path
205*d* conducting path
301 opening
303 snap-fit recess
305 snap-fit recess
307 snap-fit recess
309 snap-fit recess
311 snap-fit projection
401 second fastening spike
403 snap-fit projection
405 snap-fit projection
407 snap-fit projection
409 snap-fit projection
501 connecting sleeve
503 fastening element
505 snap-fit projection
507 snap-fit projection
509 snap-fit recess
511 snap-fit recess
515 connecting space
517 connecting space
519 first fastening spike
521 second fastening spike
523 sleeve wall
525 opening
527 opening
529*a* electrical contact
529*b* electrical contact
529*c* electrical contact
529*d* electrical contact From the foregoing description, those skilled in the art can appreciate that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

The invention claimed is:

1. An electrical connector for electrical conducting elements comprising:

a connecting sleeve capable of receiving a first conducting element; and a fastening element with a first fastening spike for form-fit fastening a first conducting element in the connecting sleeve;

wherein the fastening element is capable of being placed on the connecting sleeve to fasten the first conducting element with a form-fit in the connecting sleeve by the first fastening spike, wherein the connecting sleeve is capable of retaining a second electrical conducting element, and wherein the fastening element comprises a second fastening spike for form-fit fastening the second conducting element in the connecting sleeve, wherein the connecting sleeve includes a sleeve wall with at least one opening capable of receiving at least one of the first and second fastening spikes, wherein the connecting sleeve comprises at least one connecting space for receiving the respective electrical conducting element, and wherein at least one of the first and second fastening spikes is formed from one of plastic and an insulating plastic.

2. The electrical connector of claim 1, wherein the connecting sleeve includes a hollow cross-section.

3. The electrical connector of claim 1, wherein the fastening element is capable of being connected to the connecting sleeve by a snap-fit connection.

4. The electrical connector as claimed in claim 1, wherein the connecting sleeve includes at least one of (i) at least one snap-fit projection with the fastening element having at least one snap-fit recess for receiving the at least one snap-fit projection, and (ii) at least one snap-fit recess with the fastening element having at least one snap-fit projection.

5. The electrical connector of claim 1, wherein at least one of the first and second fastening spikes (105, 401, 519, 521) is designed to deform the respective first and second conducting elements in a form of one of (i) a depression and (ii) an opening to produce a form-fit fastening.

6. The electrical connector of claim 1, wherein at least one of the first and second fastening spikes is designed to at least one of (i) at least partially penetrate into an insulating layer of the respective first and second conducting elements and (ii) perforate an insulating layer of the respective first and second conducting elements to produce a form-fit fastening.

7. The electrical connector of claim 1, wherein at least one of the first and second fastening spikes is capable of at least one of (i) being driven through the respective one of the first and second electrical conducting elements (ii) perforating the respective one of the first and second electrical conducting elements to produce a form-fit fastening.

8. The electrical connector of claim 1, wherein the at least one of the first and second conducting elements is at least one of a PCB and a flexible PCB, wherein the at least one of PCB and flexible PCB includes a substrate and wherein at least one of the first and second fastening spikes is designed to at least one of penetrate and perforate into the respective substrate of the at least one of PCB and flexible PCB to produce a form-fit fastening.

9. The electrical connector of claim 1, wherein the at least one of the first and second electrical conducting elements includes an opening, and wherein the respective first and second fastening spike is capable of being introduced into the respective opening to produce a form-fit fastening.

10. The electrical connector of claim 1, wherein the connecting sleeve electrically contacts at least one electrical conducting path of the respective electrical conducting element.

11. The electrical connector of claim 1, wherein the connecting space comprises at least one electrical contact for electrically contacting at least one electrical conducting path of the respective conducting element.

12. The electrical connector of claim 1, wherein the fastening element and the connecting sleeve, when joined together, form at least one of a housing and a water-tight housing.

13. A method to electrically contact at least one of (i) at least one strip-like conducting path of an LED tape and (ii) at least one of a PCB and a flexible PCB by incorporating the electrical connector of claim 1.

14. The electrical connector of claim 2, wherein the hollow cross-section is a rectangular hollow cross-section.

* * * * *